US005992474A

United States Patent [19]

Miller

[11] Patent Number: 5,992,474

[45] Date of Patent: Nov. 30, 1999

[54] DEVICE FOR DISPENSING LIQUID FLUIDS

[75] Inventor: Gert Miller, Monchengladbach, Germany

[73] Assignee: Scheidt & Bachmann GmbH, Mönchengladbach, Germany

[21] Appl. No.: 08/932,290

[22] Filed: Sep. 17, 1997

[30] Foreign Application Priority Data

Apr. 10, 1997 [EP] European Pat. Off. ..... 97105906

[51] Int. Cl.[6] ..... B65B 1/04

[52] U.S. Cl. ..... 141/59; 141/83; 141/192

[58] Field of Search ..... 141/44–46, 51, 141/83, 59, 192

[56] References Cited

U.S. PATENT DOCUMENTS

| | | | |
|---|---|---|---|
| 4,360,877 | 11/1982 | Langston . | |
| 5,040,577 | 8/1991 | Pope | 141/59 |
| 5,156,199 | 10/1992 | Hartsell, Jr. et al. | 141/59 |
| 5,484,000 | 1/1996 | Hasselmann | 141/59 |
| 5,644,730 | 7/1997 | Fayfield | 395/282 |

FOREIGN PATENT DOCUMENTS

| | | |
|---|---|---|
| 0511599 | 11/1992 | European Pat. Off. . |
| 0678476 | 10/1995 | European Pat. Off. . |
| 3903603 | 8/1990 | Germany . |
| 9310036 | 5/1993 | WIPO . |

*Primary Examiner*—Steven O. Douglas
*Attorney, Agent, or Firm*—Robert W. Becker & Associates

[57] ABSTRACT

In a dispensing device for dispensing liquid fuel from at least one underground storage tank through at least one fuel nozzle, wherein the liquid fuel is conveyed by a fuel pump from the underground storage tank to the fuel nozzle, wherein the amount of liquid fuel dispensed is measured by a measuring device including an impulse sender, wherein vapors are removed from the fuel tank to be filled by a vapor pump via a vapor removal opening provided at the fuel nozzle and returned into the underground storage tank via a vapor return line, the measuring device includes a computer producing data sets comprised of address bits, data bits, and check bits for a display correlated with the fuel pump, for a control unit of the vapor pump in order to control pumping output depending on the dispensed amount of liquid fuel, and for a central computing unit of a gas station. A network is provided for transmitting the data sets to the display, the control unit of the vapor pump, and the central computing unit of the gas station.

5 Claims, 1 Drawing Sheet

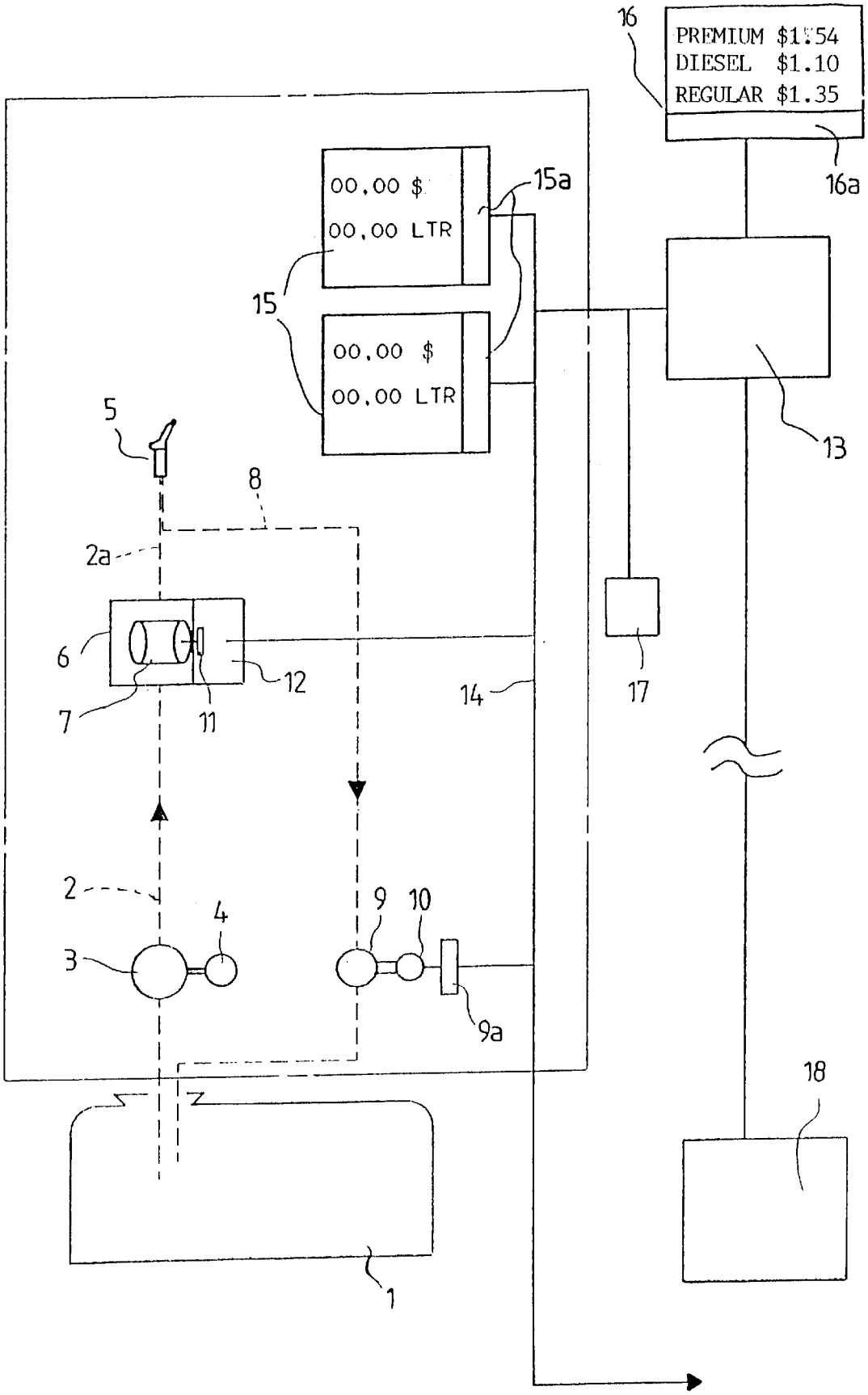
PREMIUM $1.54
DIESEL $1.10
REGULAR $1.35
00.00 $
00.00 LTR
00.00 $
00.00 LTR
16
16a
15a
15
13
5
8
2a
6
7
11
12
14
17
2
4
3
9
10
9a
18
1

DEVICE FOR DISPENSING LIQUID FLUIDS

BACKGROUND OF THE INVENTION

The present invention relates to a device for dispensing liquid fuels from at least one storage tank with at least one fuel hose having connected thereto a fuel nozzle. The fuel is pumped from the storage tank by a fuel pump and guided through a measuring device with impulse sender for determining the amount of fuel dispensed. The air/fuel vapor mixture of the fuel tank to be filled is removed by a vapor pump through a vapor opening provided within the fuel nozzle and connected to a vapor return line opening into the storage tank.

Such devices for dispensing liquid fuels are known. They comprise conventionally at least one storage tank for regular gasoline, premium gasoline, high performance premium gasoline, and diesel fuel and in general a plurality of dispensing islands for each one of these fuel types. The respectively dispensed fuel amount and the corresponding price are displayed on a display at each dispensing island together with the base price of the fuel. In order to comply with government regulations, the air/fuel vapor mixture is removed by pumping from the fuel tank to be filled and is returned to the storage tank. The output of the vapor pump used for this purpose is controlled as a function of the flow velocity of the fuel that is determined by the measuring device.

In known devices for dispensing liquid fuels, special devices such as fuel pumps, measuring devices, and vapor pumps, designed for a special task, are employed. The impulse sender connected to each measuring device produces impulses that are processed centrally within the dispensing island computer that controls the vapor pump as well as the displays. This not only requires a considerable wiring expenditure between the central computer of the dispensing island and the individual devices, but also a considerable storage expenditure for the differently designed central computers of the dispensing islands depending on the respective application and depending on the number of different fuels, pumps, and displays.

It is therefore an object of the present invention to provide a device of the aforementioned kind for dispensing liquid fuels which can be assembled from any desired number of identical modules with a wiring and installation expenditure that is as small as possible.

SUMMARY OF THE INVENTION

The dispensing device for dispensing liquid fuel from at least one storage tank through at least one fuel nozzle, wherein the liquid fuel is conveyed by a fuel pump from the at least one storage tank to the fuel nozzle, wherein the amount of liquid fuel dispensed is measured by a measuring device including an impulse sender, wherein vapors are removed from the fuel tank to be filled by a vapor pump via a vapor removal opening provided at the fuel nozzle, and are returned into the storage tank via a vapor return line, the improvement according to the present invention comprising:

The measuring device including a computer producing data sets comprised of address bits, data bits, and check bits for a display correlated with the fuel pump, for a control unit of the vapor pump, in order to control pumping output depending on the amount of liquid fuel being dispensed, and for a central computing unit of a gas station;

A network for transmitting the data sets to the display, the control unit of the vapor pump, and the central computing unit of the gas station.

Advantageously, the network is a BUS system.

Preferably, the network is a CANBUS system.

The network advantageously provides for a serial data interchange between the display, the control unit, and the central computing unit for monitoring proper function, diagnosing errors, and remote calibrating the measuring device.

The data sets are remote-transmitted to at least one service station and a diagnosis center.

According to the present invention, each measuring device has integrated therein a computer which, based on the impulses provided by the impulse sender, automatically produces based on the information supplied by the respective measuring device in regard to the type of fuel and the base price of fuel, data sets comprised of address bits, data bits, and check bits to the respective display of the dispensing island, to the control unit of the suction output of the vapor pump for controlling operation of the vapor pump based on the amount of fuel dispensed, and to the central computing unit of the gas station. The data sets are transmitted via a network to the individual devices, i.e., displays, vapor return control unit, and the central computing unit.

This inventive embodiment has the advantage that by using identical modules with computerized (intelligent) devices respective dispensing devices can be assembled for particular applications whereby before start-up it is only required to provide the individual computing devices of each individual, identical device with a respective software package for the desired task. With the inventive improvement, the installation expenditure is thus reduced but also the storage expenditure for the pumping device because each device is comprised of identical modules which must only be provided with the respective software package.

According to a further embodiment of the invention the network is a BUS system, preferably a CANBUS system.

Such network inventively allows a serial data exchange between the intelligent devices of the dispensing island and of the central computing unit, especially for monitoring proper function, for diagnosing errors of the devices as well as optionally for remote-calibrating the measuring device.

According to a further feature it is also possible to transmit the data of the devices via a data remote transmission to the service stations and the diagnosis center in order to monitor the degree of filling of the storage tank and ensure timely refilling, to control the base price adjustment of the computers integrated into the measuring device, to adjust the price level or to perform repairs that are needed according to the performed diagnostic tests.

BRIEF DESCRIPTION OF THE DRAWING

The object and advantages of the present invention will appear more clearly from the following specification in conjunction with the accompanying only drawing, in which the inventive device is schematically represented.

DESCRIPTION OF PREFERRED EMBODIMENT

The present invention will now be described in detail with the aid of a specific embodiment utilizing the only FIGURE.

The represented embodiment shows schematically an underground storage tank 1 for a liquid fuel, e.g., regular gasoline, that is supplied by pump 3 driven by motor 4 to the fuel line 2. The speed of the motor 4 is controlled by the fuel nozzle 5 that is arranged at the end of a flexible fuel hose 2*a* of the fuel line 2. The amount of dispensed fuel is determined by a measuring device 7 arranged in a housing and correlated with the fuel line 2.

In order to prevent that filling of the fuel into the tank to be filled causes air/vapor mixture to escape into the atmosphere, the fuel nozzle 5 is provided with a vapor suction opening in order to return the air/fuel vapors vial vapor return line 8 into the underground storage tank 1. A vapor pump 9 is arranged within the vapor return line 8 whereby its suction output is controlled proportionally to the dispensed amount of fuel that is determined by the measuring device 7. In the shown embodiment, the vapor pump 9 is driven by an electric motor 10 having a controllable rpm. In general, each side of a dispensing island has arranged thereat such a vapor pump 9 because on each side only one car can be refueled.

The measuring device 7 has connected thereto an impulse sender 11 whereby the measuring device 7 has correlated therewith also a computer 12. By providing the computer 12, the measuring device 7 and the impulse sender 11 together form an intelligent device because the computer 12 not only serves to compute the impulses of the impulse sender 11 to measured data. In addition, a central computing unit 13 provided at the gas station supplies the computer 12 with information in regard to the fuel type and the basic price so that the computer 12 can automatically and independently determine the price to be paid by the customer for the removed amount of fuel calculated based on the impulses of the impulse sender 11 and the information of the fuel type and the base price supplied thereto from the central computing unit via the network 14. The display 15 can be accordingly triggered or controlled and shows in addition to the base price of the fuel dispensed from the underground storage tank 11 the amount and the corresponding price for the dispensed fuel. In general, each fuel nozzle 5 has correlated therewith a display 15. For dispensing islands which can be operated from opposed sides, each fuel nozzle 5 has correlated therewith two displays 15.

In addition to producing data sets for controlling the displays 15, the computer 12 also provides data sets for controlling the suction output of the vapor pump 9 depending on the amount of dispensed fuel, i.e., data sets for controlling the respective electric motor 10. The data sets produced by the computer 12 are comprised of address bits, the data bits to be transmitted as well as control or check bits that monitor whether the data transmitted to a device have been completely and correctly received. The transmission of data sets is carried out via the network 14 which connects the individual devices to one another. In order to be able to read and evaluate the data sets send via the network 14, each of the devices connected to the network has its own computer, for example, the vapor pump 9 has the computer 9*a* and the display 15 has the computer 15*a*.

The network 14 supplies data sets produced by the computer 12 to the computer 9*a* which controls the rpm of the electric motor 10 of the vapor pump 9 such that its suction output is proportional to the flow of dispensed fuel determined by the measuring device 7 so that via the fuel nozzle 5 an amount of air/fuel vapor mixture can be removed by suction which corresponds exactly to the amount of fuel dispensed by the fuel nozzle 5.

As can be seen from the only Figure, the network 14 may be connected to further devices, i.e., a price indicator 16 with corresponding computer 16*a*, an automatic dispensing systems 17 as well as a remote data transmission apparatus with at least one computer 18 for transmitting data to a service station and a diagnosis center. The automatic fuel dispensing system 17 is provided at individual dispensing islands that can be operated with cash or chip cards.

By employing a network 14, preferably embodied as a BUS system via which the data sets produced by the individual computers of the devices are transmitted, the individual hard wiring, known from the prior art, of each individual device with the other devices is no longer necessary. The data sets produced by the individual computers are provided with an address bit set so that each data set transmitted via the network 14 will only be received by the respective computer of the addressed device for processing. Check bits can be used by the computer of the device to determine whether the received data set has been completely and correctly received. The reception of the data sets is acknowledged by the respective device computer by returning the correspondingly addressed data set to the sending computer.

The computerized (intelligent) design of the individual devices makes it possible that a fuel price change can be directly transmitted from the central computer unit 13 of the gas station, or an external computer 18 at the fuel distributor which is connected to the central computing unit 13, to the computer 12 of the measuring device 7 so that it can automatically calculate the amount to be paid by the customer during the next filling operation.

Furthermore, the intelligent embodiment of the individual devices allows for a data exchange for diagnostic and service purposes, i.e., monitoring of proper function of the individual devices as well as monitoring of the filling level of the individual storage tanks 1.

The monitoring of the function of the displays 15 and/or the price indicator 16 is performed with respective computers 15*a* or 16*a* in that the individual bars representing the numbers are monitored by measuring the current, i.e., upon switching between black and white current must flow. When this is not the case, the respective computer 1Sa or 16a, controlling the display 15 or the price indicator 16, will realize that this number is defective and signals this defect to the central computing unit 13 of the gas station and/or directly to the computer 18 of the service station or the diagnostic center.

When the computer 15*a* of the display 15 is defective, this defect is noted by the computer 12 of the measuring device 7 because this computer 12, after triggering the computer 15*a*, does not receive the respective return message of computer 15*a* indicating that the transmitted data set has been received. Accordingly, the computer 12 will send an error message to the central computing unit 13 of the gas station and/or the computer 18 of the service station/diagnostic center.

It is also possible to monitor functions of other devices, i.e., of the electric motor 10 of the vapor pump 9 or of the measuring device 7. In practice, this means that when e.g., the electric motor 10 of the vapor pump 9, its rotation being monitored, breaks down the computer 9*a* will not send a corresponding return message to the computer 12 of the measuring device 7 monitoring the vapor pump 9. When an error occurs within the measuring device 7, the computer 12 will detect that the fuel nozzle 5 has been removed and the motor 4 of the pump 3 is in operation, but that no impulses are received from the impulse sender 11. This error is transmitted also to the central computing unit 13 of the gas station and/or to the computer 18 of the service station/diagnostic center.

The measures to be taken in response to error messages depends on the type of error and the function of the monitored device. While for some errors, e.g., an error within the measuring device 7, it is necessary to switch off the respective dispensing island, it is sufficient for an error within the price indicator 16 to send via remote data transmission an error message to the computer 18 of the service station/diagnostic center of the service contractor or the fuel distributor.

In addition to these design advantages of a dispensing island with intelligent devices, it is also possible to employ these device for the purpose of remote-calibrating. However, this requires that non-represented controllable valves are present. During regularly performed calibrations it is to be determined whether the actually dispensed amount of fuel coincides with the amount of fuel detected by the impulse sender 11. In order to account for deviations between the actually dispensed amount and the amount determined by the impulse sender 11, which deviations result from unavoidable manufacturing tolerances, each computer 12 of a measuring device 7, embodied as a piston measure, has stored therein corrective values for the manufacturing tolerances of the respective measuring device 7.

In order to be able to test a piston measure of the measuring device 7 for calibrating purposes in regard to deviations resulting form wear, it is necessary to connect two measuring device 7 with the aforementioned controllable valves to a common fuel pump 3 such that the amount of fuel pumped by the pump 3 is first guided through the piston measure of the first measuring device 7 and then through the piston measure of the second measuring device 7. The pumped amount of fuel for calibration is returned into the underground storage tank 1 via a nonrepresented bypass system. With the aid of the impulse sender 11 correlated with each measuring device 7, the amount of fuel flowing through the measuring devices 7 is determined in the respective computer 12. When during the course of this test deviations between the amount of fuel determined by the two measuring devices 7 result, they are detected in the central computing unit 13 of the gas station and/or the calibration center connected via remote data transmission to the gas station. When the deviation surpasses a certain tolerance value, then the corrective value that is stored within the computer 12 for each piston measure of the measuring device 7 is amended.

Since the measuring results of the test are transmitted via the network 14 to the central computing unit 13 of the gas station and/or via a remote data transmission system to the computer of a central monitoring station, the central computing unit 13 and/or the central monitoring station (Board of Weights and Measures) can decide whether in the case of relevant deviations after a calibration test the corrective value of the piston measure should be changed in the respective computer of the measuring device 7. Since switching of the controllable valves can be performed within short periods of time, for example, during operational breaks, monitoring of the measuring device is possible practically at all times without personnel of the Board of Weights and Measures having to perform individual site inspections.

In general, it must be noted that the use of identical modules with intelligent devices, on the one hand, substantially reduces the installation expenditure and, on the other hand, considerably facilitates monitoring and servicing in regard to calibration and error diagnosis.

The present invention is, of course, in no way restricted to the specific disclosure of the specification and drawing, but also encompasses any modifications within the scope of the appended claims.

What is claimed is:

1. A dispensing device for dispensing liquid fuel from at least one storage tank through at least one fuel nozzle, wherein the liquid fuel is conveyed by a fuel pump from the at least one storage tank to the fuel nozzle, wherein the amount of liquid fuel dispensed is measured by a measuring device including an impulse sender, wherein vapors are removed from a fuel tank to be filled by a vapor pump via a vapor removal opening provided at the fuel nozzle, and are returned into the storage tank via a vapor return line, wherein the improvement comprises:

the measuring device including a computer producing data sets comprised of address bits, data bits, and check bits for a display electrically interconnected with the fuel pump, for a control unit of the vapor pump in order to control pumping output depending on the amount of liquid fuel being dispensed, and for a central computing unit of a gas station;

a network for transmitting the data sets to the display, the control unit of the vapor pump, and the central computing unit of the gas station.

2. A dispensing device according to claim 1, wherein said network is a BUS system.

3. A dispensing device according to claim 1, wherein said network is a CANBUS system.

4. A dispensing device according to claim 1, wherein said network provides for a serial data interchange between said display, said control unit, and said central computing unit for monitoring proper function, diagnosing errors, and remote-calibrating the measuring device.

5. A dispensing device according to claim 1, wherein the data sets are remote-transmitted to at least one service station or a diagnosis center.

* * * * *